US007864634B2

(12) United States Patent
Hiraya

(10) Patent No.: US 7,864,634 B2
(45) Date of Patent: Jan. 4, 2011

(54) TIMEPIECE WITH A CALENDAR MECHANISM

(75) Inventor: Eiichi Hiraya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/413,901

(22) Filed: Mar. 30, 2009

(65) Prior Publication Data

US 2009/0257318 A1 Oct. 15, 2009

(30) Foreign Application Priority Data

Apr. 10, 2008 (JP) ..... 2008-102192

(51) Int. Cl.
*G04B 19/20* (2006.01)

(52) U.S. Cl. ..... 368/37; 368/28; 368/35

(58) Field of Classification Search ..... 368/28, 368/35, 37

See application file for complete search history.

(56) References Cited

U.S. PATENT DOCUMENTS

| | | | | |
|---|---|---|---|---|
| 6,081,483 | A | 6/2000 | Capt et al. | |
| 6,711,100 | B2 * | 3/2004 | Rochat et al. | 368/35 |
| 2003/0103417 | A1 * | 6/2003 | Gabathuler et al. | 368/37 |
| 2005/0174891 | A1 * | 8/2005 | Besse | 368/37 |
| 2005/0232085 | A1 * | 10/2005 | Scheufele | 368/37 |
| 2006/0028918 | A1 * | 2/2006 | Groothuis et al. | 368/37 |
| 2007/0195650 | A1 * | 8/2007 | Kamiya et al. | 368/223 |

FOREIGN PATENT DOCUMENTS

| | | | |
|---|---|---|---|
| CN | 2560008 | Y | 7/2003 |
| CN | 2602405 | Y | 2/2004 |
| EP | 0940833 | A | 9/1999 |
| EP | 0950213 | A | 10/1999 |
| EP | 1296204 | A | 3/2003 |
| EP | 1460494 | A | 9/2004 |
| JP | 2000-065957 | A | 3/2000 |

* cited by examiner

*Primary Examiner*—Renee Luebke
*Assistant Examiner*—Jason Collins
(74) *Attorney, Agent, or Firm*—Global IP Counselors, LLP

(57) ABSTRACT

A timepiece with calendar function including a dial having a tens digit display aperture for displaying the tens digit of the date and a ones digit display aperture for displaying the ones digit of the date, and a calendar mechanism that displays the date by presenting specific numerals through the dial. The calendar mechanism includes a ones display wheel having ones markers whereby the ones digit is displayed through the ones digit display aperture, a tens display wheel having tens markers whereby the tens digit is displayed through the tens digit display aperture, a ones drive mechanism that drives the ones display wheel, and a tens drive mechanism that drives the tens display wheel. The tens markers include normal tens markers that display only the tens digit in the tens digit display aperture, and a two-digit display marker that displays a tens digit in the tens digit display aperture and a ones digit in the ones digit display aperture.

6 Claims, 5 Drawing Sheets

TIMEPIECE WITH A CALENDAR MECHANISM

BACKGROUND

1. Field of Invention

The present invention relates to a timepiece with a calendar mechanism that has a date display mechanism for displaying the date.

2. Description of Related Art

Small timepieces such as wristwatches and other timepieces with a calendar mechanism for displaying the date in the dial are known from the literature. When the calendar mechanism causes a date wheel displaying the numbers 1 to 31 near the periphery of the timepiece to rotate one revolution per month, the numbers used to display the date in such timepieces become quite small. As a result, configurations that display the ones and tens digits separately are also known from the literature (see, for example, Japanese Unexamined Patent Appl. Pub. JP-A-2000-65957.

The timepiece taught in JP-A-2000-65957 is a device that displays the dates 1 to 31 using a ones display member that advances one step per day and bears the numbers 0 to 9, and a tens display member that advances one step every ten days and bears the numbers 0 to 3.

A problem with the timepiece taught in JP-A-2000-65957, however, is that because the height (elevation) of the ones display member and the height (elevation) of the tens display member are not the same, a step occurs between the numbers in all displayed dates. Because this step between the digits can cast a shadow when the product (timepiece) is photographed, for example, care is required when determining the angle from which pictures are taken, thus making product photography more difficult.

SUMMARY

A timepiece with a calendar mechanism according to the present invention does not produce a step in the date display area and thus enables good product photography.

A first aspect of the invention is a timepiece with calendar function including a dial having a tens digit display aperture for displaying the tens digit of the date and a ones digit display aperture for displaying the ones digit of the date, and a calendar mechanism that displays the date by presenting specific numerals through the dial. The calendar mechanism has a ones display wheel having ones markers whereby the ones digit is displayed through the ones digit display aperture, a tens display wheel having tens markers whereby the tens digit is displayed through the tens digit display aperture, a ones drive mechanism that drives the ones display wheel, and a tens drive mechanism that drives the tens display wheel, the tens markers including normal tens markers that display only the tens digit in the tens digit display aperture, and a two-digit display marker that displays a tens digit in the tens digit display aperture and a ones digit in the ones digit display aperture.

This aspect of the invention can display a numeral in the ones marker group disposed to the ones display wheel through the ones digit display aperture, and can display a numeral in the tens marker group disposed to the tens display wheel through the tens digit display aperture. As a result, the date can be displayed using larger numbers than is possible when two digits are displayed in a single display window. In addition, a two-digit display marker that can display numerals for the date in both the tens digit display aperture and ones digit display aperture is also included in the tens markers of the tens display wheel.

A step between the digits can therefore be eliminated when this two-digit display marker is displayed through the tens digit display aperture and ones digit display aperture because both the tens digit and the ones digit are numerals disposed on the tens display wheel.

In addition, by displaying the tens digit and the ones digit in the two-digit display marker of the tens display wheel, the tens digit and the ones digit can be displayed at appropriate positions in the tens digit display aperture and ones digit display aperture with no deviation in the distance between the tens and ones digits or deviation in the vertical or horizontal alignment of the digits when seen from the face of the dial. Shadows are therefore not produced by a step between the digits when photographing the product, the problems and tedium of adjusting the lighting to eliminate such shadows are eliminated, and good pictures of the product can therefore be taken.

In a timepiece with a calendar function according to another aspect of the invention the ones markers of the ones display wheel include a first marker group including the sequentially ordered digits 1 to 9, a second marker group including the sequentially ordered digits 0 to 9, a third marker group including the sequentially ordered digits 0 to 9, and two non-displaying markers where digits are not displayed disposed circumferentially on the surface of the ones display wheel facing the dial at equidistant intervals enabling viewing the markers through the ones digit display aperture; the normal tens markers are the numerals 0, 1, and 2 displayed in the tens place; the two-digit display marker is the numeral 3 for the tens place and the numeral 0 or 1 for the ones place; the tens markers of the tens display wheel are disposed on the surface of the tens display wheel facing the dial with the normal tens markers followed by the two-digit display marker, the normal tens markers including the sequentially ordered digits 0, 1, 2, and the two-digit display marker including the sequentially ordered ones digits 0 and 1; the ones drive mechanism drives the ones display wheel one marker per day; and the tens drive mechanism moves the 0, 1, or 2 of the normal tens markers to the position opposite the tens digit display aperture when the 1 in the first marker group, the 0 in the second marker group, or the 0 in the third marker group moves to the position opposite the ones digit display aperture, and moves the 3 to the position opposite the tens digit display aperture of the two-digit display marker and the 0 or 1 to the position opposite the ones digit display aperture when the non-displaying marker moves to the position opposite the ones digit display aperture.

When the date is from the 1st to the 29th with this aspect of the invention, the numeral displayed in the ones digit display aperture changes day by day, and the numeral displayed in the tens digit display aperture changes every ten days. Compared with a configuration that has the numbers 1 to 31 on the date wheel and displays the date through a single calendar window, the invention can display the date using larger numerals by displaying the ones and tens digits separately, and the date can thus be read more easily.

In addition, when the date is the 30th or 31st, the "3" for the tens unit in the end-of-month markers is displayed from the tens digit display aperture, and the 0 or 1 for the ones unit displayed beside the tens unit is displayed from the ones digit display aperture. More specifically, when the date is the 30th or 31st, the date is displayed by the tens display wheel, and a step between the numeral displayed in the tens digit display aperture and the numeral displayed in the ones digit display aperture can be eliminated.

The configuration of the tens display wheel can therefore be simplified. More specifically, if the two-digit display marker is disposed to the 15th between the 1st and 29th, for example, a two-digit display marker corresponding to the 15th must be disposed continuously to the 0 and 1 of the normal tens markers corresponding to the 1st to 14th, normal tens markers for 1, 2, and 3 corresponding to the 16th to the 31st must be disposed following this two-digit display marker, and the scale of markers disposed to the tens display wheel becomes larger.

The invention enables a simpler configuration, however, because two-digit display markers for only the 30th and 31st are disposed after the normal tens markers of 0, 1, and 2.

Further preferably in a timepiece with a calendar function according to another aspect of the invention the ones display wheel is substantially circular and has five tens drive teeth disposed to the inside circumference surface of said circle at an interval corresponding to the drive interval of the tens display wheel, and the tens drive mechanism has a tens drive wheel that is driven rotationally in conjunction with the tens display wheel by the tens drive teeth.

In this aspect of the invention the tens drive teeth disposed to the ones display wheel transfer drive power to the tens drive mechanism to drive the tens display wheel. It is therefore not necessary to provide separate drive motors for the ones display wheel and the tens display wheel, and drive power from a single source can be used to drive both the ones display wheel and the tens display wheel. The configuration is thus simplified, the limited space inside a small timepiece can be used effectively, and the size of the timepiece can be reduced.

In a timepiece with a calendar function according to another aspect of the invention the ones drive mechanism includes a substantially circular ones drive wheel that is connected to the ones display wheel and has on its inside circumference a plurality of ones drive teeth corresponding to each ones marker of the ones display wheel, and a ones jumper that pushes the ones drive teeth in the date-advancing direction when the ones drive teeth rotate a specific angle. The tens display wheel has five engaging teeth that can engage the tens drive teeth. The tens drive mechanism has a tens jumper that pushes the engaging teeth in the date-advancing direction when the engaging teeth rotate a specific angle. The tens jumper pushes the engaging teeth at substantially the same time as the ones jumper pushes the ones drive teeth when the 1 of the first marker group, the 0 of the second marker group, the 0 of the third marker group, or the two non-displaying marker moves to the position opposite the ones digit display aperture.

In this aspect of the invention the ones jumper and the tens jumper can move the ones drive wheel or the tens drive wheel by means of the ones jumper or tens jumper pushing the ones drive teeth or the engaging teeth. The ones display wheel is linked to the hour and minute hand drive wheels linked to the hour and minute hands, and driving the hour and minute hand continues driving the ones display wheel when drive power is delivered from these drive wheels. The numerals displayed in the ones digit display aperture of the dial may therefore not change completely even though the date of the calendar has changed if the ones jumper is not provided.

The invention, however, has both a ones jumper and a tens jumper, and the ones jumper pushes the ones drive teeth of the ones display wheel simultaneously to when the hour and minute hand move to the 0:00 position. As a result, the ones digit marker displayed in the ones digit display aperture changes immediately to the ones digit marker for the next date.

Furthermore, when the ones display wheel moves to the position corresponding to 01, 10, 20, 30, or 31, the tens drive wheel is also driven by the tens drive tooth. Because a tens jumper is also disposed to the tens wheel, the digit displayed in the tens digit display aperture can also change simultaneously to the hour and minute hands going to 0:00, for example. More specifically, the content displayed in the ones digit display aperture and the content displayed in the tens digit display aperture can be changed at the same time. The correct date can therefore be displayed with no offset between when the ones and the tens digits of the date change.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of a timepiece with a calendar function according to the present invention is described below with reference to the accompanying figures.

Figure 1:
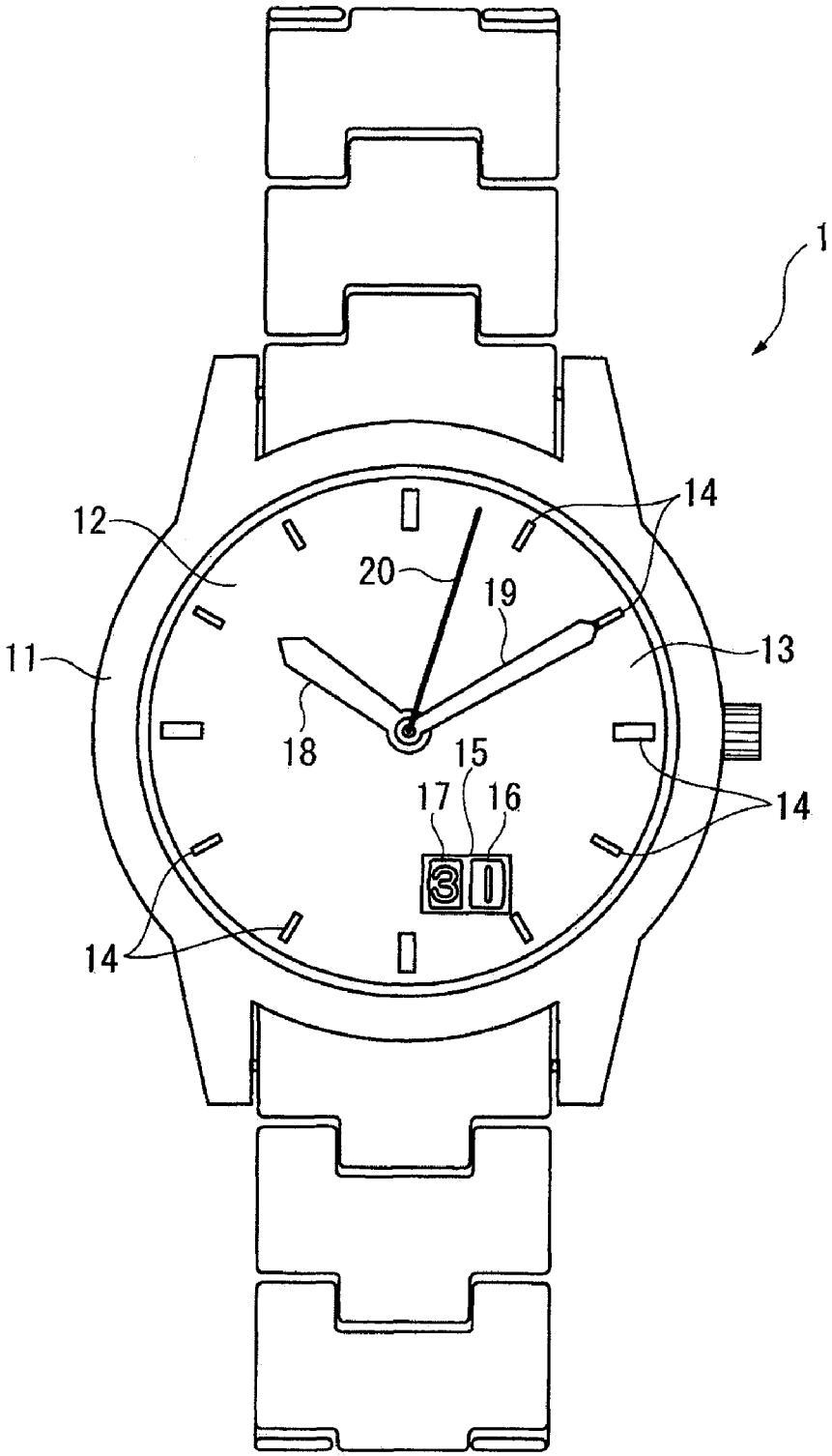
FIG. 1 is a schematic plan view of a timepiece with a calendar function according to a preferred embodiment of the invention.

FIG. 1 is a schematic plan view of a timepiece with a calendar function according to a preferred embodiment of the invention.

Figure 2:
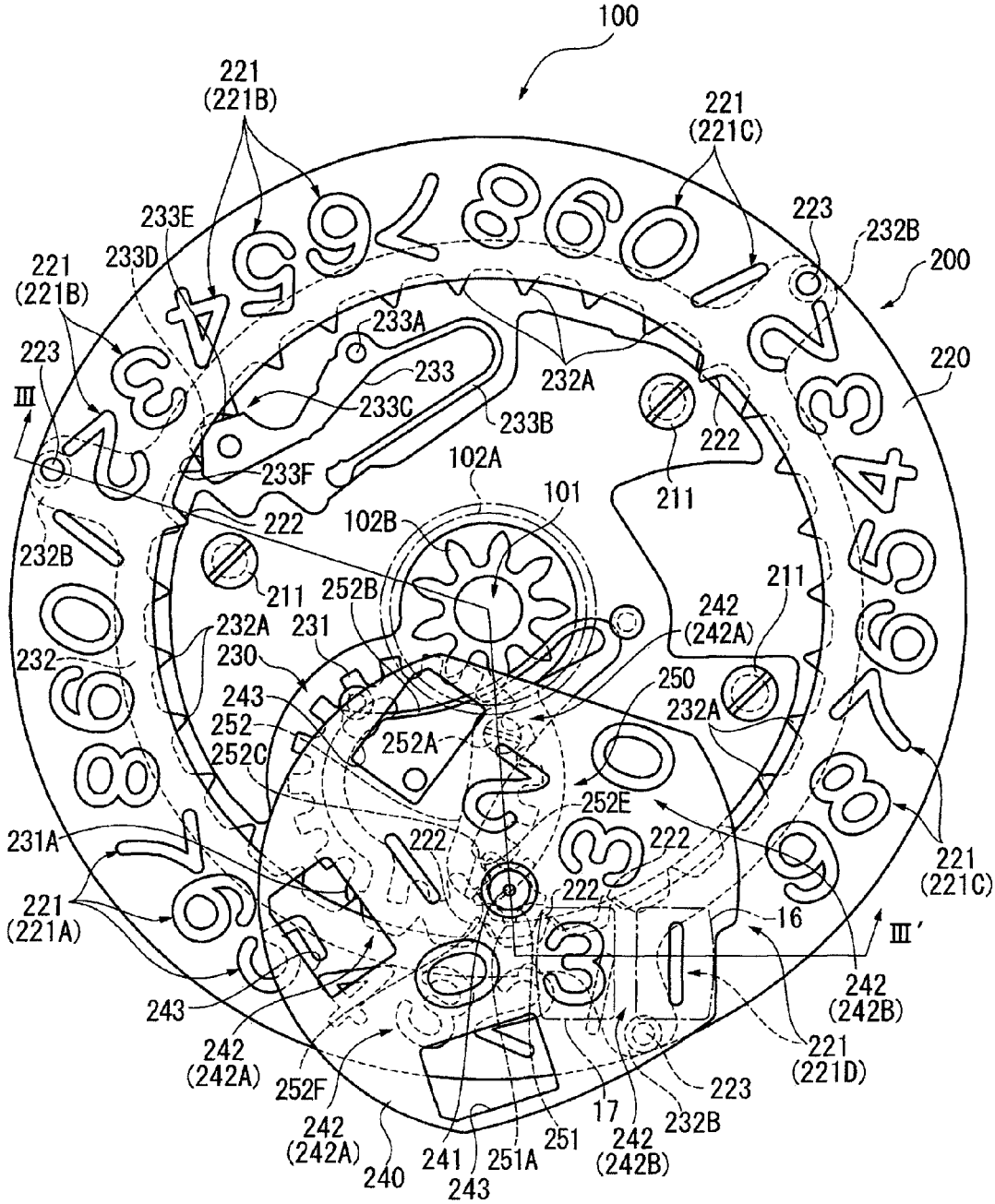
FIG. 2 is a plan view schematically showing the inside of a timepiece with a calendar function according to the invention when the dial is removed.

FIG. 2 is a plan view schematically showing the inside of a timepiece with a calendar function according to the invention when the dial is removed.

Figure 3:
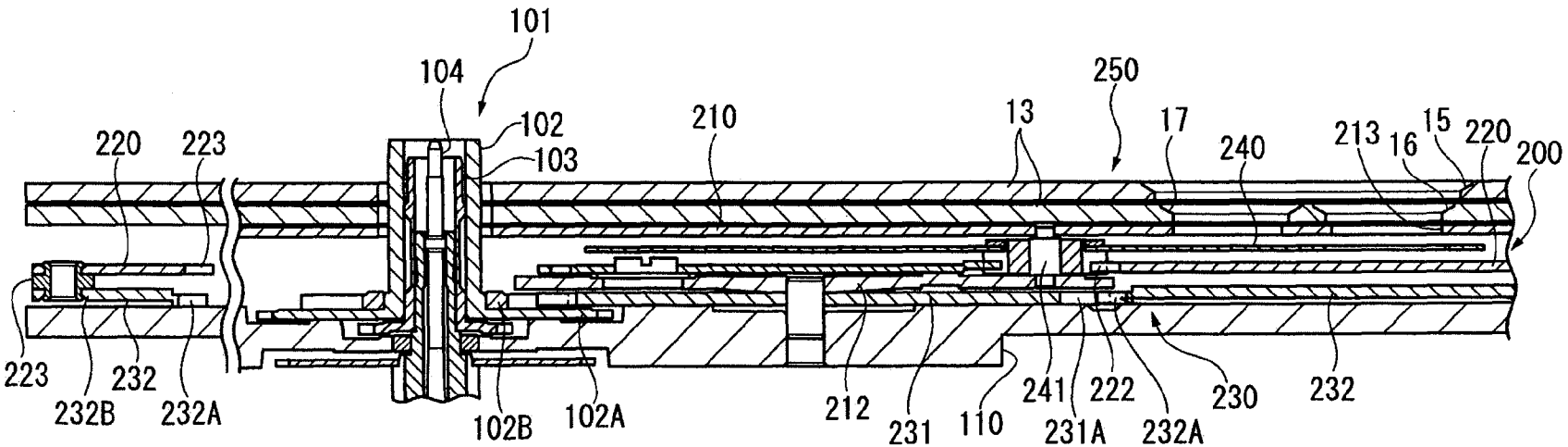
FIG. 3 is a section view through line III-III' in FIG. 2.

FIG. 3 is a section view through line III-III' in FIG. 2.

Figure 4:
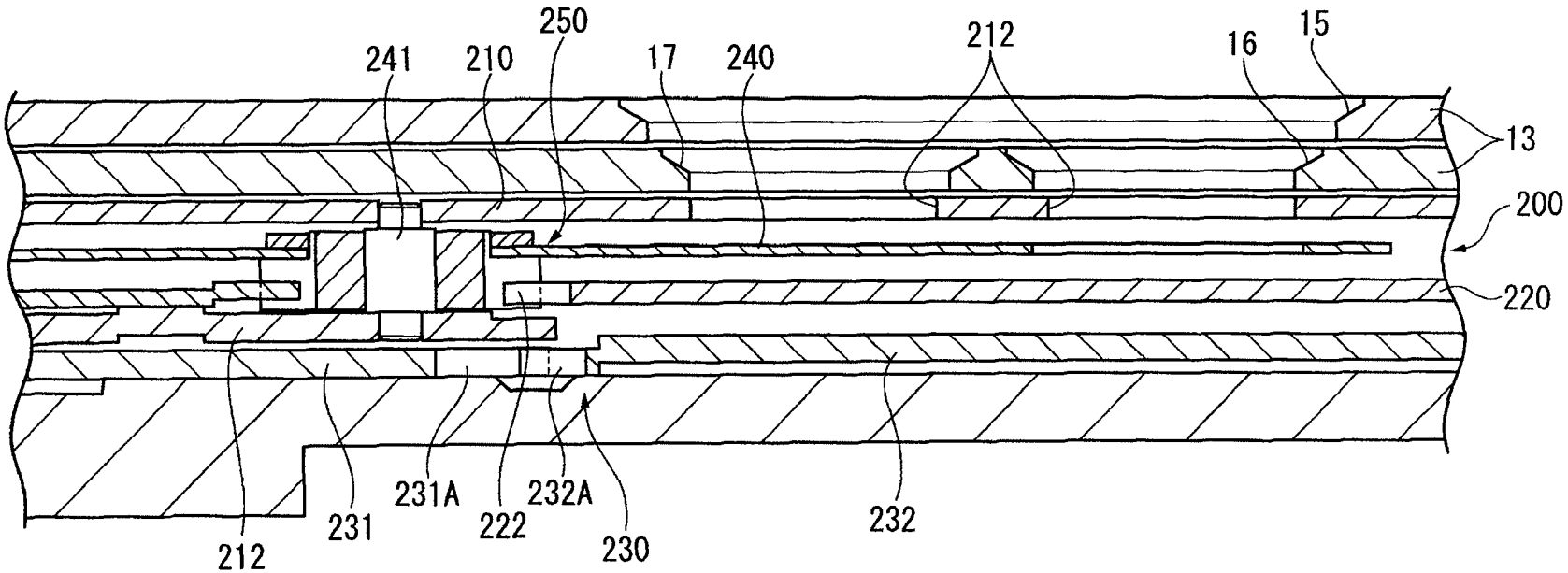
FIG. 4 is a section view through the area near the date display window when a date from 1 to 29 is displayed.

FIG. 4 is a section view through the area near the date display window when a date from 1 to 29 is displayed.

* Configuration of a Timepiece with a Calendar Function

In FIG. 1 reference numeral 1 denotes a timepiece with a calendar function, and this timepiece with a calendar function 1 (referred to below as timepiece 1) has a case 11 with a crystal 12, a dial 13 that can be seen through the crystal 12, and a movement 100 (see FIG. 2) that is contained inside the case 11.

The dial 13 is round and has markers 14 for indicating the time disposed at equal intervals around the outside edge. A date display window 15 in which the date is displayed is also rendered in the dial 13.

The date display window 15 includes a ones display aperture 16 for displaying the ones digit of the date, and a tens display aperture 17 for displaying the tens digit of the date. As shown in FIG. 2, the ones display aperture 16 and tens display aperture 17 are disposed with a specific gap therebetween.

As shown in FIG. 2, the movement 100 includes a hand drive shaft 101, a calendar mechanism 200, a hand drive mechanism not shown, a drive motor not shown that is disposed facing the back cover side of the case, a battery not shown that supplies drive power, and a control circuit unit that controls driving the timepiece 1.

The control circuit unit of the movement 100 outputs a specific pulse signal to the drive motor, and the drive motor produces drive power based on this pulse signal. The drive power produced by the drive motor is output to a hand drive mechanism, and is transferred from this hand drive mechanism to the hand drive shaft 101.

The hand drive shaft 101 includes an hour hand drive shaft 102, a minute hand drive shaft 103, and a second hand drive shaft 104. The hour hand drive shaft 102, minute hand drive shaft 103, and second hand drive shaft 104 support the hour hand 18, minute hand 19, and second hand 20, respectively, between the dial 13 and the crystal 12. The hour hand drive shaft 102, minute hand drive shaft 103, and second hand drive shaft 104 are driven rotationally by the drive power from the hand drive mechanism, and drive the hour hand 18, minute hand 19, and second hand 20 at specific drive intervals.

An hour hand drive wheel 102A to which the drive power from the drive motor is transferred, and a calendar drive transfer wheel 102B that transfers drive power to a ones date drive mechanism 230, are disposed to the hour hand drive shaft 102.

Note that in this embodiment of the invention the hour hand drive shaft 102 turns one revolution every 12 hours and turns two revolutions in one day.

* Calendar Mechanism

The calendar mechanism 200 assembled in the movement 100 is described next.

As shown in FIG. 2 and FIG. 3, the calendar mechanism 200 is disposed on a base plate 110 (see FIG. 3) opposite the dial 13 of the movement 100. The calendar mechanism 200 includes a calendar wheel train bridge 210 (see FIG. 3), a ones display wheel 220, the ones date drive mechanism 230, a tens display wheel 240, and a tens date drive mechanism 250.

The calendar wheel train bridge 210 is a substantially flat plate supported by stationary pins 211 (see FIG. 2) rising from the base plate 110 to maintain a specific gap between the calendar wheel train bridge 210 and the base plate 110. As shown in FIG. 2, the calendar wheel train bridge 210 is disposed almost touching the base plate 110 side of the dial 13, and a display aperture 213 (see FIG. 3) that is at least as large as the ones display aperture 16 and tens display aperture 17 is formed in the part of the calendar wheel train bridge 210 that is opposite the ones display aperture 16 and tens display aperture 17 of the date display window 15 in the dial 13. The calendar wheel train bridge 210 supports the tens display wheel 240 and tens drive wheel 251 so that both can rotate.

* Ones Display Wheel and Ones Date Drive Mechanism

As shown in FIG. 2, the ones display wheel 220 is substantially round following the outside edge of the movement 100, and has a plurality of ones markers denoting the ones digit of the date on the surface facing the dial 13. More specifically, thirty-one ones markers 221 are disposed at a specific equal interval in the annular area of the ones display wheel 220 facing the ones display aperture 16.

As also shown in FIG. 2, the ones markers 221 include disposed arranged in the clockwise direction first ones markers 221A including the numbers 1 to 9, second ones markers 221B including the numbers 0 to 9, third ones markers 221C including the numbers 0 to 9, and two non-displaying markers 221D that do not display numbers or markings.

Five internal tens drive teeth 222 are also formed projecting from the inside circumference surface of the ones display wheel 220, that is, the surface facing the hand drive shaft 101. More specifically, the tens drive teeth 222 are disposed at positions between the "1" and "2" and between the "2" and "3" in the first ones markers 221A, between the "1" and "2" in the second ones markers 221B, between the "1" and "2" in the third ones markers 221C, and between the non-displaying markers 221D and the "1" in the first ones markers 221A.

The ones display wheel 220 is connected by a connecting member 223 to the ones date wheel 232 of the ones date drive mechanism 230 described below, and is driven rotationally around the outside edge of the movement 100 in conjunction with the ones date wheel 232.

The ones date drive mechanism 230 includes a day-turning wheel 231, the ones date wheel 232, and a ones jumper 233.

The day-turning wheel 231 is rotatably supported on a pin protruding from the base plate 110. This day-turning wheel 231 engages the calendar drive transfer wheel 102B of the hour hand drive shaft 102, and is driven rotationally by drive power transferred from this calendar drive transfer wheel 102B. The gear ratio of the day-turning wheel 231 to the calendar drive transfer wheel 102B is 1:2 so that when the calendar drive transfer wheel 102B turns two revolutions the day-turning wheel 231 turns one revolution. The day-turning wheel 231 thus turns one revolution in 24 hours.

Teeth capable of engaging the calendar drive transfer wheel 102B are disposed to the outside circumference of the day-turning wheel 231, and one of these teeth is a date wheel drive tooth 231A that projects further to the outside than the other teeth.

This date wheel drive tooth 231A can engage a ones drive tooth 232A disposed on the inside circumference of the ones date wheel 232. As a result, the day-turning wheel 231 drives the ones date wheel 232 only when the date wheel drive tooth 231A engages the ones drive tooth 232A while the day-turning wheel 231 turns. More specifically, the day-turning wheel 231 causes the ones date wheel 232 to advance one step at a frequency of once every 24 hours.

In addition, the day-turning wheel 231 has a notched part 231B rendered in an arc clockwise to the outside edge of the day-turning wheel 231 formed between the date wheel drive tooth 231A and the tooth that is adjacent thereto on the counterclockwise side of the date wheel drive tooth 231A. This imparts elasticity to the portion where the date wheel drive tooth 231A is disposed protruding distally to the outside from the notched part 231B, and imparts a buffer action that prevents damage to the date wheel drive tooth 231A when, for example, excessive stress is applied to the date wheel drive tooth 231A when manually setting the date.

The ones date wheel 232 is a circular member disposed along the outside edge of the movement 100, and is supported rotatably around the hour hand drive shaft 102 on the base plate 110. The ones date wheel 232 is formed so that the diametric dimension from the hour hand drive shaft 102 is substantially equal to the diametric distance from the hour hand drive shaft 102 to the ones display wheel 220, and is disposed to a position overlapping the ones display wheel 220 in the thickness direction of the timepiece 1.

As also described above, the ones date wheel 232 has day wheel connecting fingers 232B protruding radially from the outside edge. More specifically, there are three day wheel connecting fingers 232B disposed equidistantly around the outside edge of the ones date wheel 232. A connecting member 223 is affixed to the distal end part of each day wheel connecting finger 232B, and the ones date wheel 232 and ones display wheel 220 are engaged with each other by these connecting members 223. As a result, drive power from the day-turning wheel 231 causing the ones date wheel 232 to rotate also causes the ones display wheel 220 to turn.

The ones drive teeth 232A are disposed at equal intervals around the inside circumference of the ones date wheel 232. More specifically, the ones date wheel 232 has thirty-one ones drive teeth 232A disposed at positions corresponding to the gaps between the ones markers 221 of the ones display wheel 220. When the date wheel drive tooth 231A of the day-turning wheel 231 engages and rotationally drives any one of the ones drive teeth 232A of the ones date wheel 232, the engaged ones drive tooth 232A is pushed and the ones date wheel 232 is driven rotationally counterclockwise the distance of one interval between the ones drive teeth 232A.

The ones jumper 233 is disposed to a position not overlapping the tens drive wheel 251 of the calendar mechanism 200. The ones jumper 233 has an elongated shape as shown in FIG. 2, and one end part is supported freely pivotably on the base plate 110 by a ones jumper pin 233A. A ones jumper spring 233B is formed continuously to the one end part (the base end part) of the ones jumper 233 that is secured by the ones jumper pin 233A.

The ones jumper spring 233B extends lengthwise to the ones jumper 233, the distal end side is formed curving toward the center of the movement 100, and the distal end part is positioned by a positioning unit not shown. As a result, the distal end part of the ones jumper 233 on the opposite side as the base end part is urged to the outside.

A ones jumper switching unit 233C is formed at the distal end part of the ones jumper 233 opposing the ones drive teeth 232A of the ones date wheel 232.

This ones jumper switching unit 233C has a finger 233D that protrudes from its center toward the ones date wheel 232, and inclined surfaces 233E and 233F that slope from the finger 233D toward both ends away from the ones date wheel 232.

As a result, when the ones date wheel 232 turns, the ones drive tooth 232A pushes against the inclined surface 233E of the ones jumper switching unit 233C, and the ones jumper switching unit 233C is pushed to the inside. When the ones drive tooth 232A then passes the finger 233D of the ones jumper switching unit 233C, the urging force of the ones jumper spring 233B pushes the ones jumper switching unit 233C to the outside and the inclined surface 233F pushes the ones drive tooth 232A counterclockwise.

The timing when the ones drive tooth 232A passes the finger 233D of the ones jumper switching unit 233C is suitably adjusted to the timing when the hour hand 18 and minute hand 19 are moved by the hand drive mechanism to the positions indicating 0:00.

* Tens Display Wheel and Tens Date Drive Mechanism

The tens display wheel 240 is substantially round and is rotatably supported by the tens wheel shaft 241 disposed between the calendar wheel train bridge 210 and the date wheel guide plate 212 affixed to the base plate 110. As shown in FIG. 2, the tens display wheel 240 has tens markers 242 denoting the tens digit of the date and the ones digit of the end-of-month dates ("30" and "31") on the surface facing the dial 13.

More specifically, the tens display wheel 240 has five tens markers 242 disposed at equal intervals through the annular area opposite the date display window 15. The tens markers 242 includes normal tens markers 242A and end-of-month tens markers 242B.

The normal tens markers 242A render a scale whereby one of the numbers 0, 1, or 2 is presented in the area opposite the tens display aperture 17 and a ones display aperture 243 is positioned in the area opposite the ones display aperture 16.

The end-of-month tens markers 242B render a scale whereby a "3" is positioned in the area opposite the tens display aperture 17 and a "0" or "1" is positioned opposite the ones display aperture 16.

The tens markers 242 are disposed clockwise around the tens display wheel 240 with the normal tens markers 242A followed by the end-of-month tens markers 242B. The normal tens markers 242A include the tens digits 0, 1, and 2 ordered sequentially clockwise, and the end-of-month tens markers 242B include the ones digits 0 and 1 following sequentially clockwise from the normal tens markers 242A.

The tens date drive mechanism 250 includes a tens drive wheel 251 and a tens jumper 252.

Figure 5:
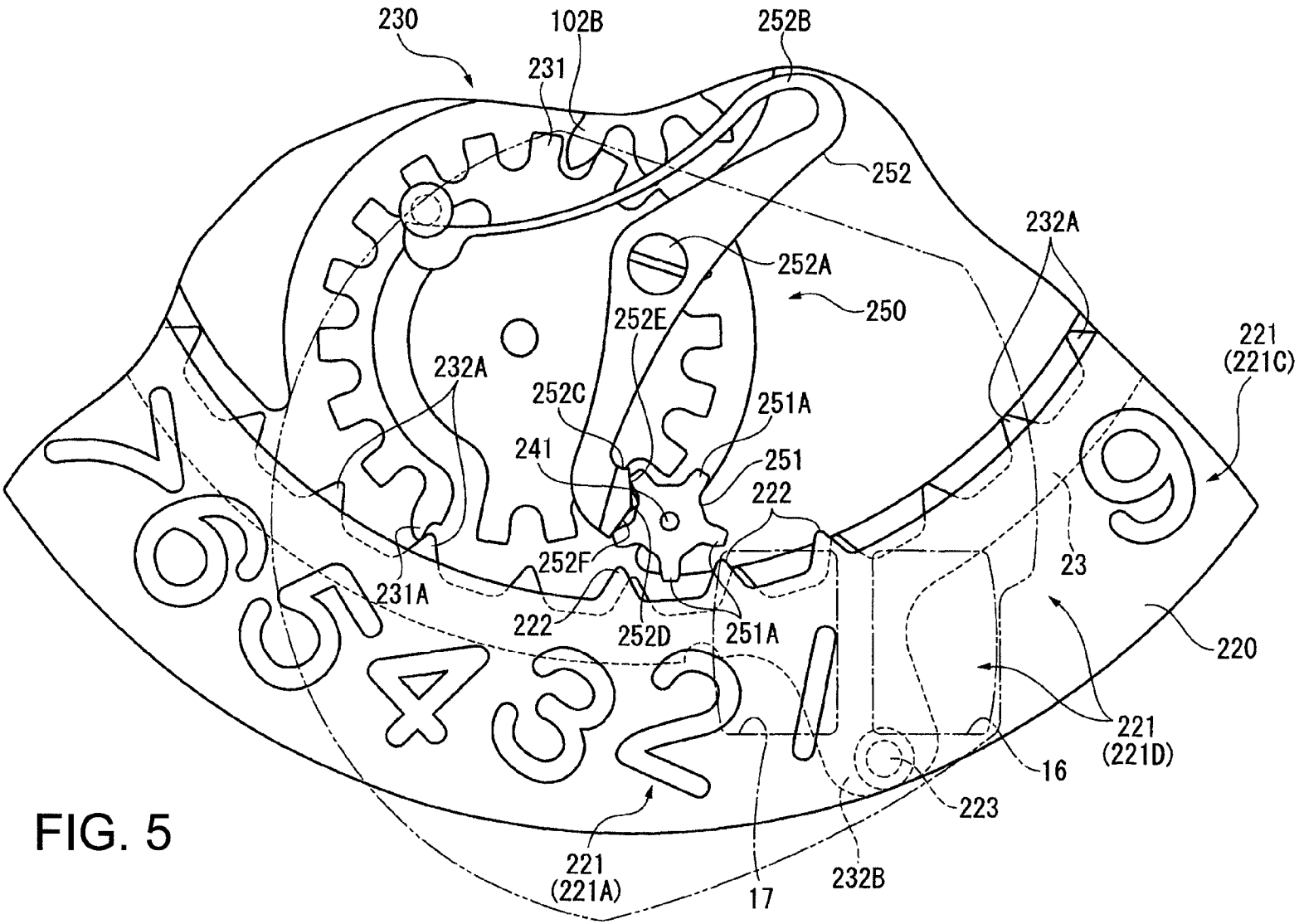
FIG. 5 is an enlarged view of the area near the tens wheel drive mechanism in a timepiece with a calendar function according to the invention.

FIG. 5 is an enlarged view of the tens date drive mechanism shown in FIG. 2.

The tens drive wheel 251 is affixed coaxially to the tens drive wheel 251, that is, to the tens wheel shaft 241, and is driven rotationally in conjunction with the tens wheel shaft 241. As shown in FIG. 5, five teeth 251A are disposed equidistantly around the outside circumference of the tens drive wheel 251. These teeth 251A are disposed so that they can engage the tens drive teeth 222 of the ones display wheel 220, and the tens drive wheel 251 is driven rotationally by the tens drive teeth 222 engaging the teeth 251A when the ones display wheel 220 turns.

At the timing when the tens drive wheel 251 is turned by the tens drive tooth 222 disposed between the 2 and the 3 in the first ones markers 221A group on the ones display wheel 220, the 1 in the first ones markers 221A of the ones display wheel 220 moves to a position opposite the ones display aperture 16, and the tens display wheel 240 turns so that the 0 in the normal tens markers 242A group of markers is opposite the date display window 15. As a result, the 0 on the tens display wheel 240 is displayed in the tens display aperture 17 of the date display window 15, and the 1 on the ones display wheel 220 is displayed because the ones display aperture 243 of the tens display wheel 240 is opposite the ones display aperture 16.

At the timing when the tens drive wheel 251 is turned by the tens drive tooth 222 disposed between the 1 and the 2 in the second ones markers 221B group on the ones display wheel 220, a 1 on the tens display wheel 240 is displayed in the tens display aperture 17 of the date display window 15 and a 0 on the ones display wheel 220 is displayed in the ones display aperture 16.

At the timing when the tens drive wheel 251 is turned by the tens drive tooth 222 disposed between the 1 and the 2 in the third ones markers 221C group on the ones display wheel 220, the 2 on the tens display wheel 240 is displayed in the tens display aperture 17 of the date display window 15 and a 0 on the ones display wheel 220 is displayed in the ones display aperture 16.

At the timing when the tens drive wheel 251 is turned by the tens drive tooth 222 disposed between the non-displaying markers 221D and the 1 in the first ones markers 221A group on the ones display wheel 220, the non-displaying marker 221D on the ones display wheel 220 moves to a position opposite the ones display aperture 16, and the tens display wheel 240 turns so that the 0 in the end-of-month tens markers 242B group of markers is opposite the date display window 15. As a result, the 3 in the end-of-month tens markers 242B of the tens display wheel 240 is displayed in the tens display aperture 17 of the date display window 15, and the 1 for the ones digit on the end-of-month tens markers 242B of the tens display wheel 240 is displayed in the ones display aperture 16.

At the timing when the tens drive wheel 251 is turned by the tens drive tooth 222 disposed between the 1 and the 2 in the first ones markers 221A group on the ones display wheel 220, a 3 for the tens digit on the end-of-month tens markers 242B is displayed in the tens display aperture 17 of the date display window 15 and a 1 for the ones digit in the end-of-month tens markers 242B of the tens display wheel 240 is displayed in the ones display aperture 16.

The distal end parts of these teeth 251A are substantially flat and adjust the switching timing of the tens jumper 252 described below.

The tens jumper 252 is disposed on the same plane as the tens drive wheel 251 of the date wheel guide plate 212. Similarly to the ones jumper 233, the tens jumper 252 is long with one end part supported freely pivotably on the date wheel guide plate 212 by a tens jumper pin 252A. A tens jumper spring 252B is formed continuously to the one end part (the base end part) of the tens jumper 252 secured by the tens jumper pin 252A.

The tens jumper spring 252B extends lengthwise to the tens jumper 252, the distal end side is formed curving toward the center of the movement 100, and the distal end part is positioned by a positioning unit not shown. As a result, the distal end part of the tens jumper 252 on the opposite side as the base end is urged to the outside.

A tens jumper switching unit 252C is disposed to the distal end part of the tens jumper 252 opposite the teeth 251A of the tens drive wheel 251. The tens jumper switching unit 252C has a finger 252D with the center thereof protruding toward the tens wheel shaft 241, and inclined surfaces 252E and 252F that slope from the finger 252D away from the tens drive wheel 251 toward both ends. As a result, when the tens drive wheel 251 turns, the teeth 251A push the inclined surface 252E of the tens jumper switching unit 252C, and the tens jumper switching unit 252C is pushed to the inside.

Furthermore, because the distal ends of the teeth 251A are flat as described above, the finger 252D of the tens jumper switching unit 252C contacts the flat at the distal end of the tooth 251A. When the tens drive wheel 251 then continues turning and the finger 252D of the tens jumper switching unit 252C passes the edge of the flat at the distal end of the teeth 251A, the urging force of the tens jumper spring 252B pushes the tens jumper switching unit 252C to the outside, and the inclined surface 252F pushes the tooth 251A counterclockwise.

The size of the flat part at the distal ends of the teeth 251A is appropriately set so that the timing when the teeth 251A are pushed by the finger 252D of the tens jumper switching unit 252C is substantially simultaneous to the timing when the ones jumper 233 pushes the ones drive tooth 232A by means of the ones jumper switching unit 233C.

* Operation of the Timepiece with a Calendar Function

The calendar display operation of the timepiece 1 described above is described next.

When drive power is transferred from the hand drive mechanism to the hour hand drive shaft 102 in this timepiece 1, drive power is transferred from the calendar drive transfer wheel 102B of the hour hand drive shaft 102 to the day-turning wheel 231, causing the day-turning wheel 231 to turn one revolution per day. The date wheel drive tooth 231A of the day-turning wheel 231 engages the ones drive tooth 232A of the ones date wheel 232, and causes the ones date wheel 232 to advance one step counterclockwise.

When the hour and minute hand go to 0:00, the hand drive mechanism causes the ones jumper 233 to push the ones drive tooth 232A, causing the ones date wheel 232 to rotate immediately, and causing the ones display wheel 220 to rotate in conjunction with the ones date wheel 232. As a result, the ones markers 221 presented in the ones display aperture 243 changes once a day.

When the ones display wheel 220 is driven rotationally causing the tens drive tooth 222 on the inside of the ones display wheel 220 to engage the teeth 251A of the tens drive wheel 251, drive power is also transferred to the tens drive wheel 251 and the tens drive wheel 251 is thus also driven one step counterclockwise. When the ones jumper 233 pushes the ones drive tooth 232A out, the tens jumper 252 pushes the teeth 251A, and the tens drive wheel 251 turns immediately. More specifically, when the hour and minute hand go to 0:00, the hand drive mechanism causes the ones display wheel 220 and the tens display wheel 240 to rotate simultaneously.

As a result, when the date goes to the first (01), tenth (10), or twentieth (20), the tens digits in the normal tens markers 242A on the tens display wheel 240 move to the position opposite the tens display aperture 17, and the ones display aperture 243 in the normal tens markers 242A of the tens display wheel 240 and the ones markers 221 of the ones display wheel 220 move to positions opposite the ones display aperture 16.

One of the numbers 0, 1, and 2 for the tens digit in the normal tens markers 242A of the tens display wheel 240 is thus displayed from the tens display aperture 17, and one of the ones digits 0 to 9 in the ones markers 221 of the ones display wheel 220 is displayed from the ones display aperture 16.

When the date goes to 30 or 31, however, one of the end-of-month tens markers 242B on the tens display wheel 240 moves to the position opposite the date display window 15 and the ones display wheel 220 is hidden by the tens display wheel 240. The 3 for the tens digit in the end-of-month tens markers 242B of the tens display wheel 240 is thus displayed from the tens display aperture 17, and the 0 or 1 for the ones digit in the end-of-month tens markers 242B of the tens display wheel 240 is displayed from the ones display aperture 16.

* Effect of the Timepiece with a Calendar Function

As described above, the date display window 15 in a timepiece 1 according to the invention includes a ones display aperture 16 and a tens display aperture 17, the ones markers 221 disposed to the ones display wheel 220 can be displayed from the ones display aperture 16, and the tens markers 242 disposed to the tens display wheel 240 can be displayed from the tens display aperture 17. Compared with a configuration in which single two-digit numbers are displayed in a single window, the size of the numbers in each digit of the date displayed in the date display window 15 can be increased, the date can be rendered easier to read, and the design and appearance can be improved.

In addition, the end-of-month tens markers 242B of the tens display wheel 240 include a "3" for the tens digit displayed in the tens display aperture 17 and a "0" (or "1") as the ones digit displayed in the ones display aperture 16. Therefore, when the end-of-month tens markers 242B of the tens display wheel 240 move to a position opposite the date display window 15, both numbers displayed from the date display window 15 are on the tens display wheel 240 and a step between the digits can be eliminated. The tens digit and ones digit can also be positioned appropriately to the tens display aperture 17 and ones display aperture 16, and both vertical and horizontal deviation caused by deviation in the spacing between digits or the positioning of the digits can be eliminated. Because shadows caused by a step between the digits can thus be eliminated during product photography, for example, good product pictures in which a step between the digits of the date are not apparent can be easily taken without the need for complicated or tedious adjustments in lighting, for example.

Furthermore, because the end-of-month dates "30" and "31" are both displayed on the same plane and can be presented with a different appearance than the other dates of the month, that it is the end of the month can be made readily apparent to the viewer, and the viewer can readily know that the month is about to change.

The tens markers on the tens display wheel 240 include a normal tens markers 242A group including the three tens digits 0, 1, and 2, and a end-of-month tens markers 242B group of two-digit numerals presenting the numbers 30 and 31, disposed equidistantly around the circumference.

As a result, the number of tens markers 242 disposed on the tens display wheel 240 can be reduced compared with a configuration in which the two-digit display is any of the numbers 1 to 29, the configuration of the tens display wheel 240 can be simplified and the size can be reduced.

The ones date wheel 232 and the ones display wheel 220 are also connected by a linking pin and rotationally driven on the same axis. The ones display wheel 220 has a tens drive tooth 222 disposed at a prescribed position on the inside circumference, and the tens drive wheel 251 is driven rotationally by this tens drive tooth 222 and rotationally drives the tens display wheel 240.

As a result, the ones display wheel 220 and tens display wheel 240 can be driven together, and problems caused by the ones digit and the tens digit of the date shifting can be avoided. Furthermore, because drive power from the hour hand drive shaft 102 is transferred through the day-turning wheel 231 to the ones date wheel 232, drive power from the hour hand drive shaft 102 can drive both the ones display wheel 220 and tens display wheel 240. A dedicated motor for driving the calendar mechanism 200 is therefore not necessary, power can be saved, and the limited space inside the timepiece can be used effectively because it is not necessary to provide space for such a dedicated motor.

The ones date wheel 232 is pushed and driven by the ones jumper 233, and the tens drive wheel 251 is pushed and driven by the tens jumper 252. The date displayed in the date display window 15 can therefore be changed immediately, and problems such as the date not being clearly displayed because a midpoint between adjacent markers is presented in the ones display aperture 16 or tens display aperture 17 can be avoided.

In addition, when the date changes to 01, 10, or 20, the ones jumper 233 and tens jumper 252 respectively and simultaneously push the ones date wheel 232 and tens drive wheel 251. Problems such as "19" or "00" being displayed because of a difference in the timing when the ones digit and the tens digit change when the date goes to "10, " for example, can therefore be prevented, and the appropriate date can be displayed in the date display window 15.

In addition, the ones jumper 233 and tens jumper 252 respectively push the ones date wheel 232 and tens drive wheel 251 when the hour hand 18 and minute hand 19 go to 0:00. As a result, the date displayed in the date display window 15 changes simultaneously with the change in the date.

* Other Embodiments

The invention is not limited to the embodiment described above and can be varied and improved in many ways without departing from the scope of the accompanying claims.

For example, a configuration in which the ones jumper switching unit 233C and tens jumper switching unit 252C side are urged toward to the ones drive tooth 232A and teeth 251A by the urging force of a ones jumper spring 233B and tens jumper switching unit 252C that are freely pivotably disposed is described as the ones jumper 233 and tens jumper 252 above, but the invention is not so limited.

Alternatively, a configuration in which a top-shaped jumper member is urged toward the ones drive tooth 232A and teeth 251A by a coil spring or other urging member may be rendered as the ones jumper or tens jumper.

Further alternatively, the distal end part of the ones drive tooth 232A may be flat, and the ones date wheel 232 could be driven by the same operation as the teeth 251A.

The tens drive wheel 251 is driven by the tens drive tooth 222 disposed to the ones display wheel 220 so that the tens display wheel 240 turns in the foregoing embodiment, but the tens drive wheel could be driven directly by drive power transferred from the hand drive shaft.

In addition, a separate motor for driving the calendar mechanism 200 may be provided. Further alternatively, both a drive motor for driving the ones display wheel 220 and a drive motor for driving the tens display wheel 240 may be provided.

The tens display wheel 240 is described as having the numbers 30 and 31 in the end-of-month tens markers 242B as two-digit display units, but a configuration having a beginning-of-month tens marker that presents 0 as the tens digit and 1 as the ones digit may alternatively be rendered as a two-digit display unit. In this configuration normal tens markers presenting the digits 1, 2, and 3 as the tens digit are disposed following this beginning-of-month tens marker. In addition, the ones display wheel has one non-displaying marker, a first ones marker group including the digits 2 to 9, a second ones marker group including the digits 0 to 9, a third ones marker group including the digits 0 to 9, and an end-of-month marker group including the digits 0 and 1. This marker arrangement affords the same effect as the embodiment described above, and can eliminate a step between the tens digit and the ones digit when "01" is displayed in the date display window 15.

Tens drive teeth 222 are also disposed at positions between the "1" and "2" and between the "2" and "3" in the first ones markers 221A, between the "1" and "2" in the second ones markers 221B, between the "1" and "2" in the third ones markers 221C, and between the non-displaying markers 221D and the "1" in the first ones markers 221A in the embodiment described above, but the invention is not so limited. More specifically, the tens drive tooth 222 can be suitably disposed according to the position of the date display window 15 on the dial 13 and the relative positions of the tens display wheel 240 and tens drive wheel 251 to the date display window 15, and any configuration enabling displaying the dates 1 to 31 as a result of the tens drive tooth 222 rotationally driving the tens drive wheel 251 is conceivable.

A ones display aperture 243 corresponding to the ones display aperture 16 is rendered in the normal tens markers 242A group of the tens display wheel 240, but the invention is not so limited. For example, the tens display wheel 240 may be notched at the position of the normal tens markers 242A group opposite the ones display aperture 16.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2008-102192, filed Apr. 10, 2008 is expressly incorporated by reference herein.

What is claimed is:

1. A timepiece with a calendar function, comprising:

a dial having a tens digit display aperture for displaying tens digit of date and a ones digit display aperture for displaying ones digit of the date; and a calendar mechanism that displays the date by presenting specific numerals through the dial, the calendar mechanism including a ones display wheel having ones markers with which the ones digit is displayed through the ones digit display aperture, a tens display wheel having tens markers with which the tens digit is displayed through the tens digit display aperture, a ones drive mechanism that drives the ones display wheel, and a tens drive mechanism that drives the tens display wheel, the tens markers including five markers including normal tens markers and two-digit display markers, the normal tens markers being numerals 0, 1, and 2 that display only the tens digit of the date in the tens digit display aperture, and the two-digit display markers being numerals 30 and 31 that display the tens digit of the date in the tens digit display aperture and the ones digit of the date in the ones digit display aperture, the ones display wheel and the tens display wheel being not concentric.

2. The timepiece with the calendar function described in claim 1, wherein the ones markers of the ones display wheel include a first marker group including sequentially ordered numerals 1 to 9, a second marker group including sequentially ordered numerals 0 to 9, a third marker group including sequentially ordered numerals 0 to 9, and two non-displaying markers disposed circumferentially on a surface of the ones display wheel facing the dial at equidistant intervals enabling viewing the markers through the ones digit display aperture, the two non-displaying markers not displaying numerals, the tens markers of the tens display wheel are disposed on a surface of the tens display wheel facing the dial with the normal tens markers followed by the two-digit display markers, the normal tens markers including sequentially ordered numerals 0, 1, 2, and the two-digit display markers including sequentially ordered ones numerals 0 and 1, the ones drive mechanism drives the ones display wheel one marker per day, and the tens drive mechanism moves the numerals 0, 1, or 2 of the normal tens markers to a position opposite to the tens digit display aperture when the numeral 1 in the first marker group, the numeral 0 in the second marker group, or the numeral 0 in the third marker group moves to a position opposite to the ones digit display aperture, and moves the numeral 3 to the position opposite to the tens digit display aperture of the two-digit display markers and the numeral 0 or 1 to the position opposite the ones digit display aperture when one of the non-displaying markers moves to the position opposite to the ones digit display aperture.

3. The timepiece with the calendar function described in claim 1, wherein the ones display wheel is substantially circular and has five tens drive teeth disposed to an inside circumference surface of the ones display wheel at an interval corresponding to a drive interval of the tens display wheel, and the tens drive mechanism has a tens drive wheel that is driven rotationally in conjunction with the tens display wheel by the tens drive teeth.

4. The timepiece with a calendar function described in claim 3, wherein the ones drive mechanism includes a substantially circular ones drive wheel that is connected to the ones display wheel and that has on an inside circumference of the ones drive wheel a plurality of ones drive teeth corresponding to each of the ones markers of the ones display wheel, and a ones jumper that pushes the ones drive teeth in a date-advancing direction when the ones drive teeth rotate a specific angle, the tens display wheel has five engaging teeth that engage the tens drive teeth;

the tens drive mechanism has a tens jumper that pushes the engaging teeth in the date -advancing direction when the engaging teeth rotate a specific angle, and the tens jumper pushes the engaging teeth at substantially the same time as the ones jumper pushes the ones drive teeth when the numeral 1 of the first marker group, the numeral 0 of the second marker group, the numeral 0 of the third marker group, or one of the two non-displaying markers moves to be displayed through the ones digit display aperture.

5. A timepiece with a calendar function, comprising:

a dial having a tens digit display aperture for displaying tens digit of date and a ones digit display aperture for displaying ones digit of the date; and a calendar mechanism that displays the date by presenting specific numerals through the dial, the calendar mechanism including a ones display wheel having ones markers with which the ones digit of the date is displayed through the ones digit display aperture, a tens display wheel having a first, second, third, fourth, and fifth tens markers, a ones drive mechanism that drives the ones display wheel, and a tens drive mechanism that drives the tens display wheel, the first tens marker having a first tens digit place and a first ones digit place, the first tens digit place being numeral 0, the first ones digit place being a first aperture, the second tens marker having a second tens digit place and a second ones digit place, the second tens digit place being numeral 1, the second ones digit place being a second aperture, the third tens marker having a third tens digit place and a third ones digit place, the third tens digit place being numeral 2, the third ones digit place being an third aperture, the fourth tens marker having a fourth tens digit place and a fourth ones digit place, the fourth tens digit place being numeral 3, the fourth ones digit place being numeral 0, the fifth tens marker having a fifth tens digit place and a fifth ones digit place, the fifth tens digit place being numeral 3, the fifth ones digit place being numeral 1, the ones display wheel and the tens display wheel being not concentric.

6. The timepiece with the calendar function described in claim 5, wherein the ones markers of the ones display wheel include a first marker group including sequentially ordered numerals 1 to 9, a second marker group including sequentially ordered numerals 0 to 9, a third marker group including sequentially ordered numerals 0 to 9, and two non-displaying markers disposed circumferentially on a surface of the ones display wheel facing the dial at equidistant intervals enabling viewing the markers through the ones digit display aperture, the two non-displaying markers not displaying numerals the ones drive mechanism drives the ones display wheel one marker per day, the numeral 0 of the first tens marker being displayed through the tens digit display aperture when the numeral 1 of the first marker group is displayed though the ones digit display aperture, the numeral 1 of the second tens marker being displayed through the tens digit display aperture when the numeral 0 of the second marker group is displayed through the ones digit display aperture, the numeral 2 of the third tens marker being displayed through the tens digit display aperture to be displayed when the numeral 0 of the third marker group is displayed through the ones digit display aperture, the fourth or fifth tens marker being displayed through the ones and tens digit display apertures to be displayed when one of the non-display markers is at the ones digit display aperture.

* * * * *